US005957790A

United States Patent [19]

Carfo

[11] Patent Number: 5,957,790

[45] Date of Patent: Sep. 28, 1999

[54] BAT MASTER

[76] Inventor: Sylvio Carfo, 5622 N. McVicker, Chicago, Ill. 60646

[21] Appl. No.: 08/960,198

[22] Filed: Oct. 29, 1997

[51] Int. Cl.[6] ..... A63B 69/00

[52] U.S. Cl. ..... 473/429; 473/422; 473/430

[58] Field of Search ..... 473/423, 426, 473/429, 430, 436, 437, 506, 507, 508, 431, 147, 148, 108, 109, 160, 197, 213, 214; 273/329, 330, 331, 335, 317.5, 145, 149

[56] References Cited

U.S. PATENT DOCUMENTS

| | | | |
|---|---|---|---|
| 4,664,375 | 5/1987 | Tetreault | 473/429 |
| 4,679,790 | 7/1987 | Ham | 473/429 |
| 5,004,234 | 4/1991 | Hollis | 273/26 R |
| 5,035,424 | 7/1991 | Liao | 273/26 R |
| 5,076,580 | 12/1991 | Lang | 273/26 R |
| 5,255,911 | 10/1993 | Preston | 473/423 |
| 5,303,914 | 4/1994 | Cooksey | 473/429 |
| 5,427,369 | 6/1995 | Baquet | 473/429 |
| 5,435,545 | 7/1995 | Marotta | 273/26 R |

*Primary Examiner*—Sam Rimell
*Attorney, Agent, or Firm*—Patent & Trademark Services; Thomas Zack; Joseph H. McGlynn

[57] ABSTRACT

A batting practice apparatus having a lower support base with a vertically disposed upright support assembly with at least one horizontally disposed extension arm located over a conventional home plate. A tethered suspended ball simulating a baseball in appearance is located near the end of the arm over a lower home plate. The ball may be suspended from different arm positions correlated to the different home plate positions for different simulated thrown balls after they have passed over different parts of a lower home plate within the "strike zone". Added features include a counter for counting the number of ball rotations for struck balls around its their section arm extensions and height adjustments for the extension arms relative to the upright support. A motor may impart motion to the suspended baseball to simulate a thrown ball in flight as the batter attempts to strike it. To tone muscles while striking a simulated or actual baseball, a second larger and heavier suspended ball may be hung from another arm inserted in different positions on the upright support assembly.

9 Claims, 6 Drawing Sheets

BAT MASTER

BACKGROUND OF THE INVENTION

Anyone who has ever played the game of baseball knows that mastering the proper hitting or battering of the thrown ball is an essential elements of the game. To assist potential and actual batters in mastering this skill various types of batting tees have been developed that are mounted adjacent to an actual or simulated home plate. The relationship between the ball when struck and the home plate is important to permit the batter/player to know if the ball is within the strike zone.

The ball may be suspended or mounted in a fixed position relative to the lower home plate. With many such mounts the ball to be struck or batted is positioned upon a vertical adjustable support while the batter attempts to strike the ball with a bat at these positions. In some cases home plate is considered below the vertical mounted position or it may be undefined. In any event in such batting practice setups, the ball may be propelled from its mount or may be retained on it.

The present invention relates to such a batting practice tee having a vertical adjustment assembly for a suspended practice ball, which can be hit by a left or right handed hitters, and is designed to develop and tone essential batting muscles while increasing the users perception of the correct strike zone.

DESCRIPTION OF THE PRIOR ART

Batting practice apparatuses to assist a player in striking a baseball when it is in the "strike zone" over home plate are known. For example, U.S. Pat. No. 5,004,234 to Hollis, discloses an adjustable batting tee having a pair of opened slots on a horizontal support with two pedestals at each support end.

In the Liao reference (U.S. Pat. No. 5,035,424) a batting practice device has a support with a cable embedded in a shell that is coupled to the upper end of a base.

The Lang batting practice reference (U.S. Pat. No. 5,076,580) describes a foot positioning apparatus which is pivotally attached to a member representing home plate where the vertically supported ball is mounted.

In U.S. Pat. No. 5,435,545 to Marotta a vertical pole has a series of laterally extending shafts spaced at different heights along its length. At the ends of these shafts are ball tees.

The present batting practice apparatus invention provides for a base with a supported vertical member having a horizontally disposed extension with a plurality of ball suspending end positions whose locations relate to the strike zone as more further set forth in this specification.

SUMMARY OF THE INVENTION

This invention relates to a batting practice apparatus having a lower base with a vertically disposed upright assembly on which a vertically adjustable horizontally disposed adjustable extension arm has a plurality of different ball suspension end positions. Each suspension position represents a different ball location over a lower simulated home plate considered within the "strike zone". Added features include a counter for counting the number of ball rotations of the struck ball around its extension arm, vertical height adjustments for the extensions relative to the upright assembly, two different weighted balls—one for increasing normal batting resistance—and a third much larger suspended ball used to tone muscles when struck.

It is the primary object of the present invention to provide for an improved apparatus to aid in batting practice.

Another object is to provide for a batting practice apparatus wherein a suspended ball to be struck can be located at different positions relative to the different strike zone positions over a home plate.

These and other objects and advantages of the present invention will become apparent to readers from a consideration of the ensuing description and the accompanying drawings.

DESCRIPTION OF THE PREFERRED EMBODIMENT

Figure 1:
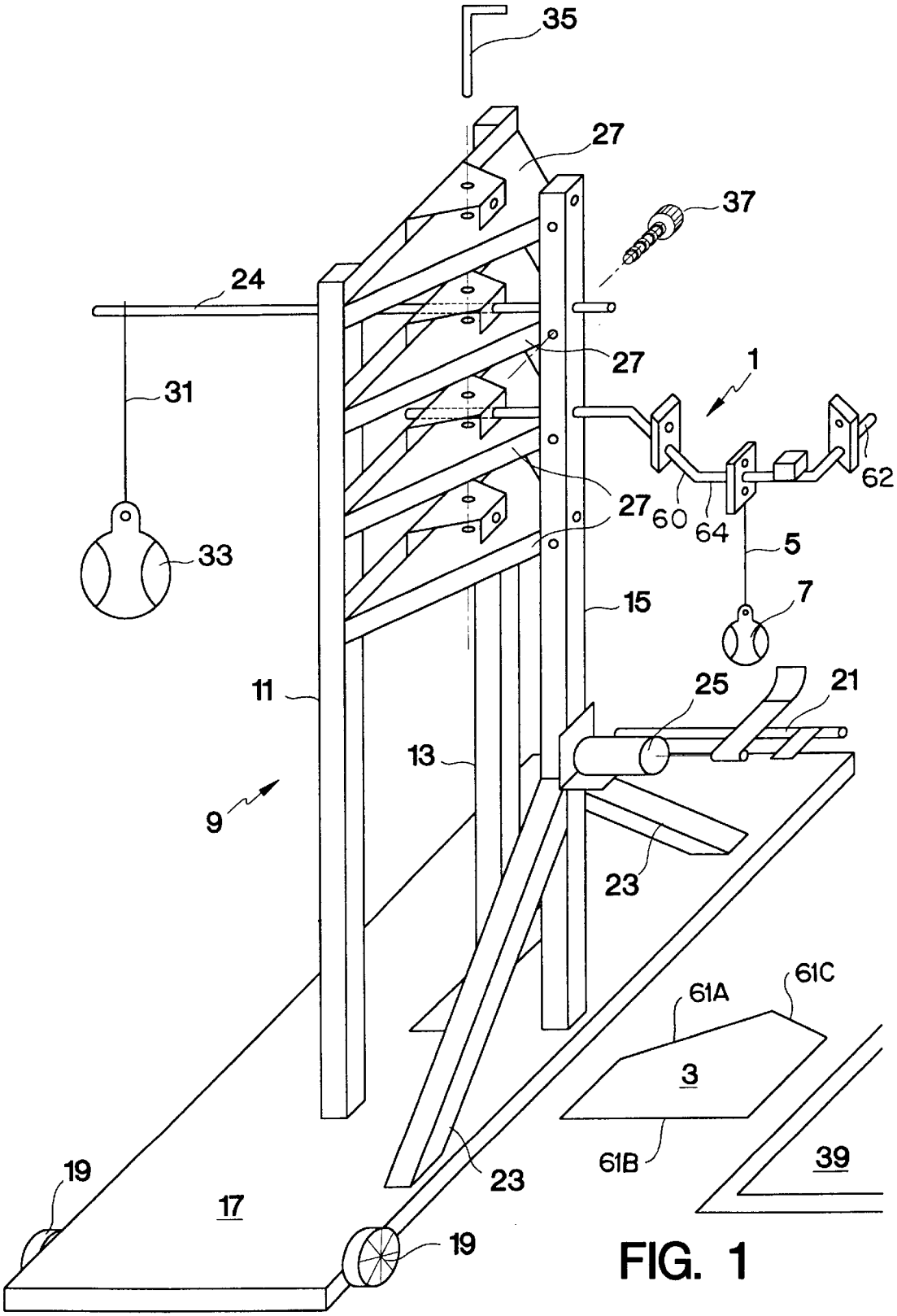
FIG. 1 is a front perspective view of the invention's preferred embodiment with one of its extension arms suspended over home plate.

FIG. 1 is a front perspective view of the invention's preferred embodiment with its vertically adjustable extension arm 1 vertically suspended over home plate 3. Suspended by a tether 5 from the arm 1 and vertically disposed over the plate is the ball 7. Supporting the arm and the tether with its suspended ball is the upright support assembly designated generally by the number 9.

The upright support assembly has three parallel vertically disposed post members 11, 13 and 15 arranged in a triangular configuration when viewed from above. At their lower ends each of posts are firmly mounted to a flat horizontal base 17 having two spaced front wheels 19 and a rear handle 21. With this base mounting the entire assembly may be transported to different locations on the field or elsewhere.

Also shown in FIG. 1 are the supporting side braces 23 for front vertical support post 15, the optional motor assembly 25, the generally triangular shaped post joining four bracket assemblies 27, the straight arm 24 with its tethered (31) suspended heavier and larger ball 33, the L-shaped steel pin 35 and the screw 37(shown engaged) used to fasten the extension arm assembly 1 into a hole in the front upright post 15. The details of these different components and assemblies and their working interrelationship will become apparent as the different separate elements are described hereafter.

Also partially shown in FIG. 1 to the right of the plate 3 is one of the batting boxes 39 located on the ground at the prescribed conventional distance and orientation from home plate. A similar batting box usually appears on the opposite side of the plate (i.e. it would be under the base 17) but is not visible.

Figure 2:
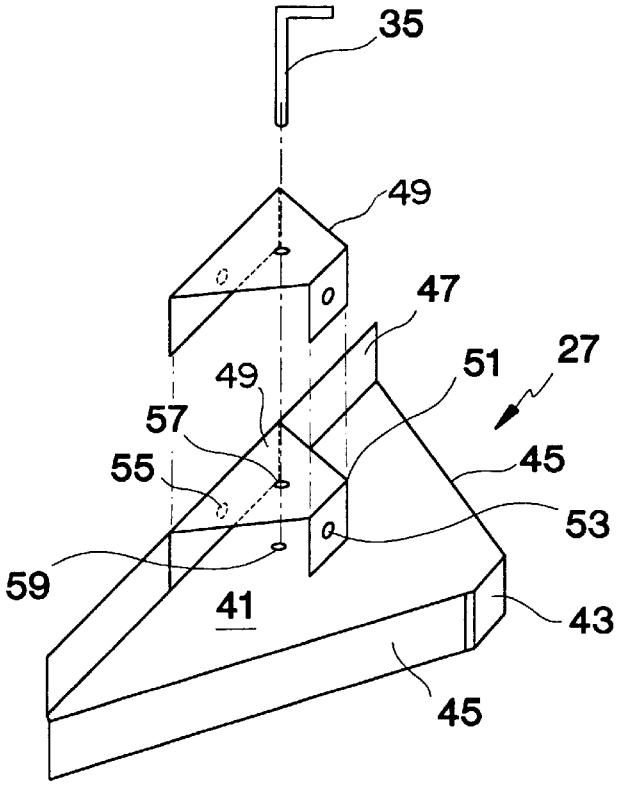
FIG. 2 is an enlarged perspective view of the extension arm support bracket used in the FIG. 1 embodiment.

FIG. 2 is an enlarged perspective view of the one of the four identical extension arm support brackets 27 used in the FIG. 1 embodiment. The upper flat triangular surface 41 is flatten on one of the apexes apron edges 43 where it meets or engages the flat side surface of support pole 15. The other two side apron edges 45 extend downwardly about the same distance as the front apron edge 43. A fourth back apron edge 47 extends in the opposite or upward direction from the base 41 and acts as a back support for the attached extending support member 49.

Support member 27 is generally triangular shaped with a front flatten downwardly facing member 51 have a 1 inch center hole 53 used to receive the cylindrical inch diameter support arm 1 (see FIG. 1). A similar one inch diameter aligned hole 55 is located at the rear support apron edge 47 and is also used to receive the same arm 1 . Located in the surface of the horizontally disposed member 49 is a one quarter of an inch diameter pin receiving hole 57 which is vertically aligned with a lower hole of the same diameter hole 59 located in the surface 41. Thus, when the L-shaped pin 35 is inserted into the two holes 57 and 59 it engages a side channel in the inserted arm extension 1 which prevents the arm from turning. Each of the four identical brackets 27 function in a similar manner to support the inserted arm 1 and prevent it from rotating when one of the pins 35 is inserted as described.

Figure 3:
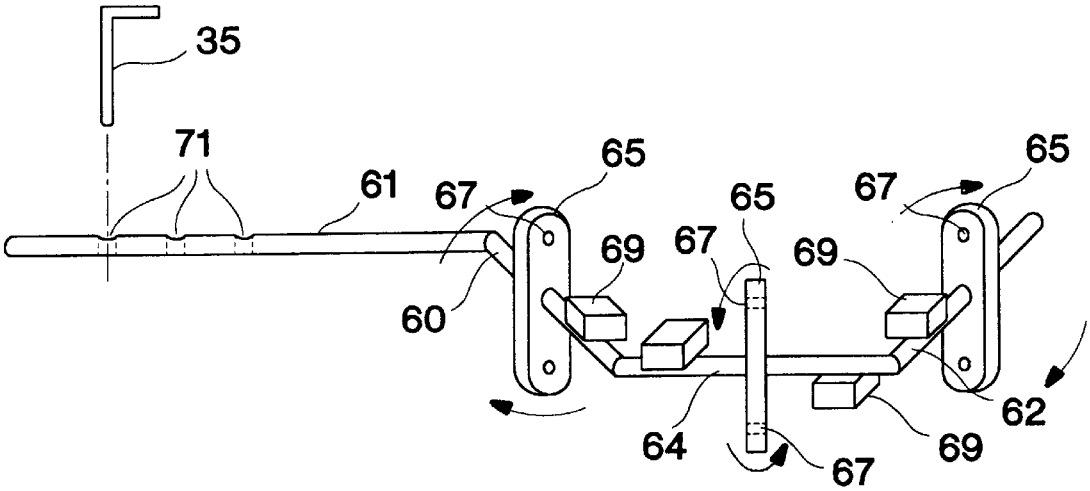
FIG. 3 is a front perspective view of the extension arm used in the FIG. 1 embodiment.

FIG. 3 is a front perspective view of the extension arm 1 used in the FIG. 1 embodiment. The arm is essentially a one inch diameter round steel rod having a bowed out middle section and two angled joined sections all of which are joined to a straight rear arm segment 61. The suspended extension arm's three bowed out sections consist of a tubing member having a first angled straight inner section 60 located nearest the upright support post 15, a free end angled section 62 oriented to be parallel to one (61A) of the home plate sides, and a joined center section 64 oriented to be parallel to another side 61B and a side of home plate 3. The inner section 60 is parallel to the base side 61C.

The three joined sections making up the arm's bowed out sections appear to resemble part of an octagon with the center section 64 having the same joining angular orientation to its two joined sided sections. Each of these three straight sections have centered rotatably mounted upright members 6 with two upper and lower spaced rope receiving holes 67 used to attach the ball's tether. Three conventional rotation counters 69 each operatively associated with a separate member 65 are used to count the number of rotations for the member 65 when an attached suspended tethered ball is struck by a batter to cause the member 65 to rotate around its mounted arm.

At the arm's straight section 61 are three spaced one-quarter inch vertical side notches 71 each of which can independently receive an inserted pin 35 to prevent the rotation of the arm 1 as described with respect to FIG. 2. By having three spaced pin receiving notches or partial holes 71 the rod arm 1 may be adjusted horizontally with respect to its vertical supports posts and the "strike zone" of the plate 3 changed and.

Figure 4:
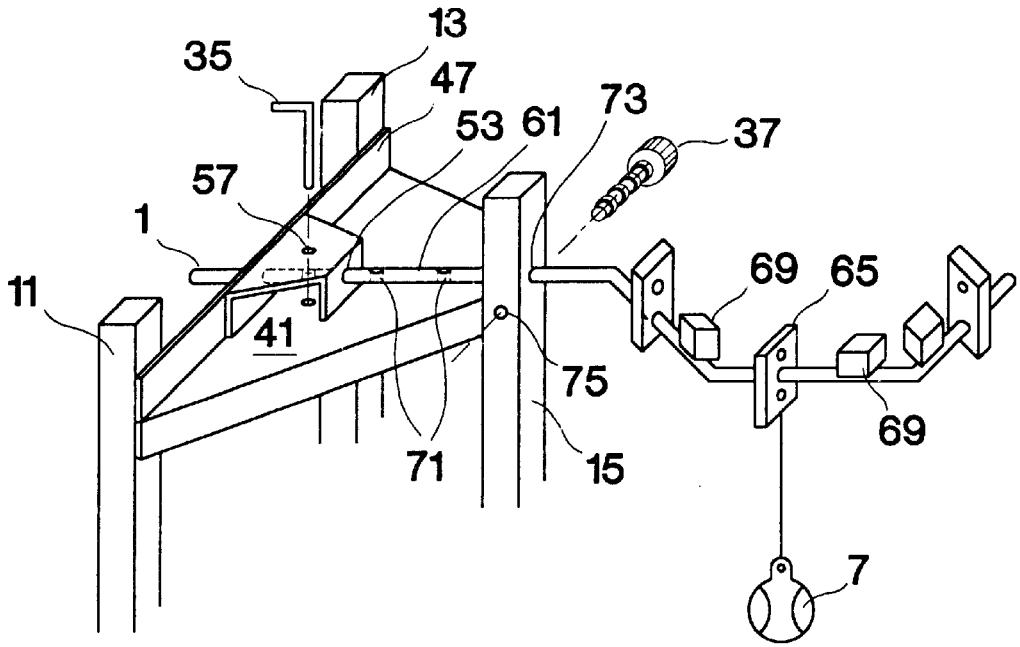
FIG. 4 is a front perspective view illustrating the mounting of the FIG. 1 extension arm to the upright assembly with a ball suspended over home plate.

FIG. 4 is a front perspective view illustrating the mounting of the FIG. 1 extension arm 1 to the upright assembly 9 with a ball 7 suspended over home plate (not shown). The round steel rod making up the extension arm 1 extends through a horizontal hole 73 in upright post 15, through the holes 53 and 55 in triangular support bracket members 51 and 47, respectively. The smaller (0.25 inch diameter) side post hole 75 extends through the post 15 and intersects the other larger (one inch diameter) through post hole 73 at approximately a right angle. The set screw 37 fits into the side hole 75 and is used to engage the inserted rod arm to fix it in place with respect to the post. Thus, by inserting the pin 35 in one of the spaced notches 71 the arm is prevented from rotation while the inserted set screw 37 prevents the arm's horizontal movement.

Figure 5:
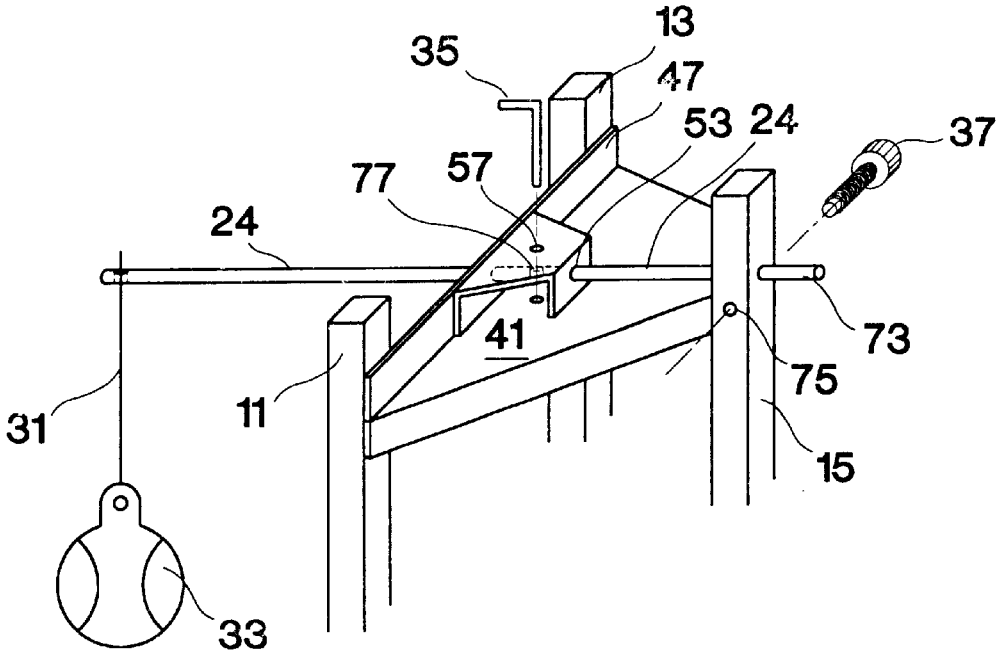
FIG. 5 is a front perspective view of the mounting extension arm for the larger heavier ball shown in the FIG. 1 embodiment.

FIG. 5 is a front perspective view of the mounting extension arm for the larger heavier ball 33 shown in the FIG. 1 embodiment. This larger heavier ball is used to strike at and build up the hitters strength not to become proficient with "strike zone" near home plate. As with the segmented arm 1, the straight support arm 24 extends through the holes 53, 55 and 73, however, the ball suspension end is oppositely directed towards the rear of the upright support assembly 9. Similarly, the pin 35 is inserted into a notch 77 in the arm 24 to prevent its rotation while the set screw 37 is inserted into post hole 75 to prevent the arm's horizontal movement.

Figure 6:
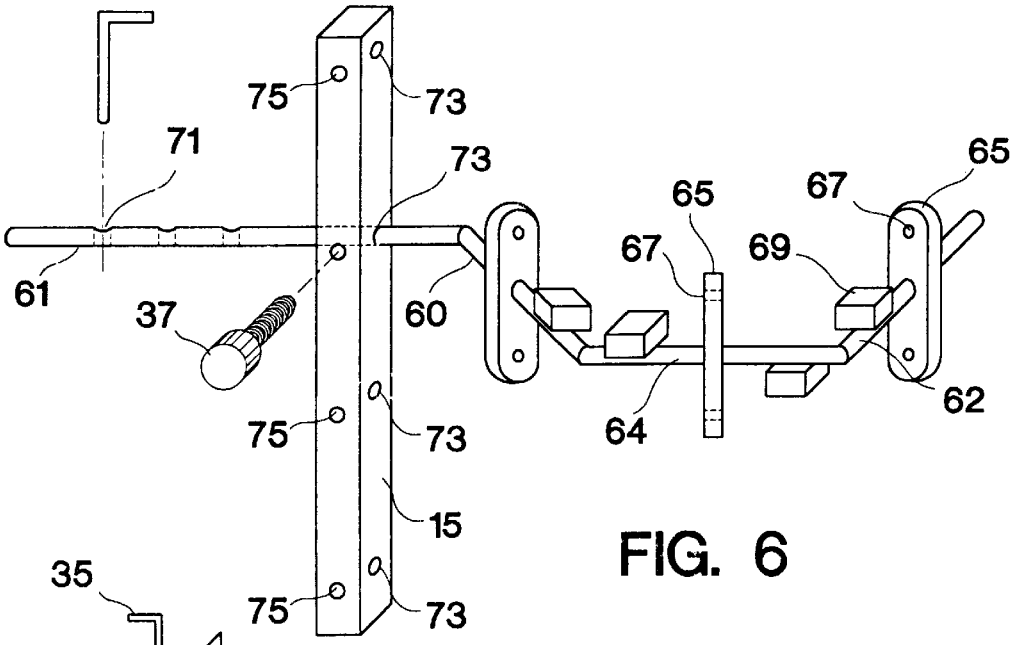
FIG. 6 is a front perspective view of the mounting used for the vertically adjustable extension arm suspending the smaller ball shown in the FIG. 1 embodiment.

FIG. 6 is a front perspective view of the mounting used for the vertically adjustable extension arm 1 suspending the smaller ball shown in the FIG. 1 embodiment. Only the front support post 15 support is shown in this figure it being understood that the two other posts as in FIGS. 1 and 5 are also engaged by the arm 1. The set screw 37 is shown being inserted from the opposite side of through post hole 75 to force the rod tight against the surface of the upright support post. Since, several different vertical heights are contemplated for the support arms, several spaced different hole sets(73 and 75) are depicted along the vertical length of the post 15. Each hole set is capable of receiving the extension arm 1 or the straight arm 24 as shown in FIG. 5 to allow for such vertical adjustments.

Figure 7:
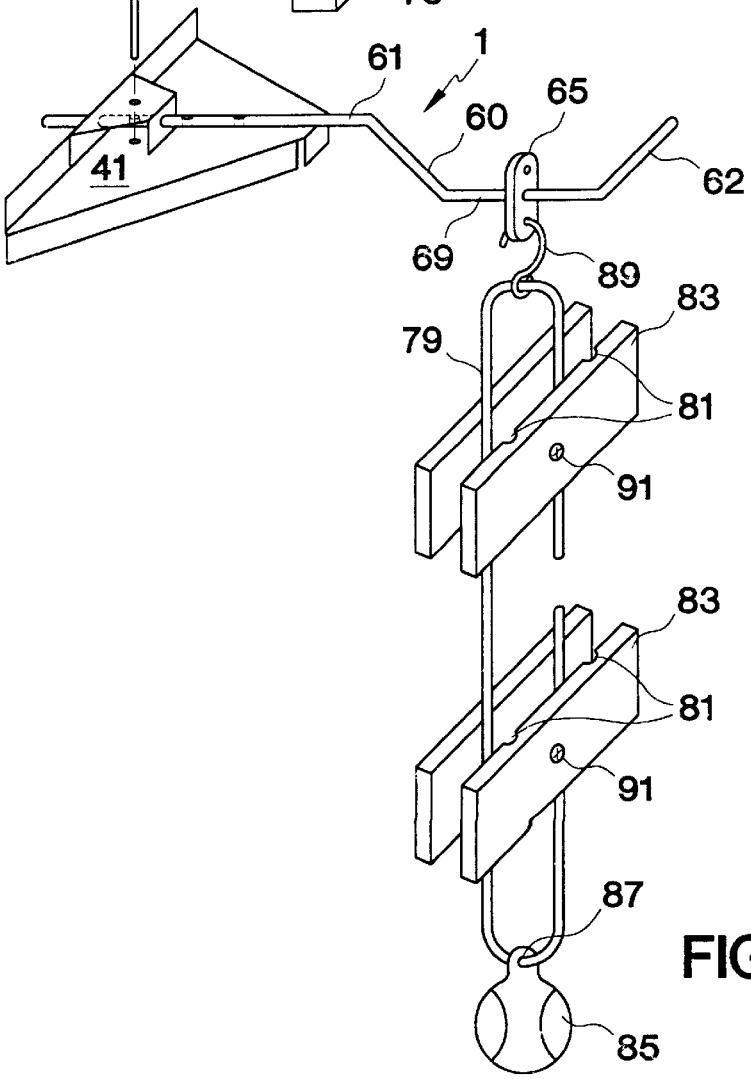
FIG. 7 is a front perspective view of a cable clamp used to adjust the height of the suspended ball shown in the FIG. 1 embodiment.

FIG. 7 is a front perspective view of a cable clamp used to adjust the height of the tethered suspended ball 7 shown in the FIG. 1 embodiment. A nylon rope 79 is inserted into two sets of spaced slots 81 in the clamps 83. A ball retainer 85 with a rope receiving upper hole 87 supports the suspended ball at its lower end while an upper S-hook 89 mounts the rope 79 to the arm 1 at its upper end. Set screws 91 extend through the two clamps 83 and are used to force each of the clamp's two sections together to retain the rope within their slots 81.

In use, you adjust the vertical height of the ball as desired and then tighten the set screws of the two clamps to retain the ball at this height. If additional height adjustments are necessary, then the arm 1 can be inserted into different hole sets in the post 15 and bracket assemblies 41. This clamp arrangement allows a user to adjust the placement of the suspended ball relative to the support arm's position to insure that the user is hitting in the strike zone.

Figure 8:
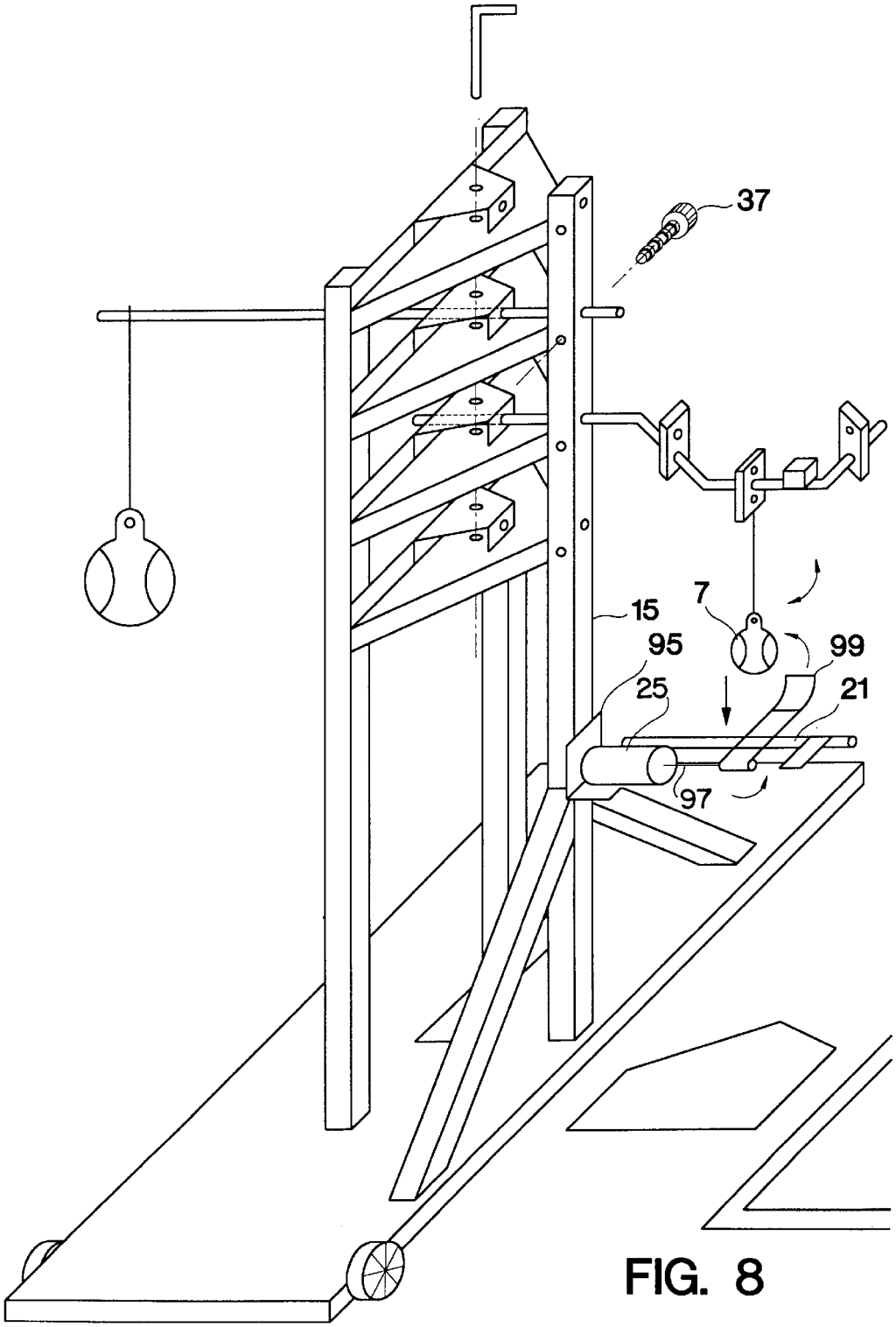
FIG. 8 is a front perspective view of an optional motor used to contact and release the suspended ball mounted on its extension arm as in the FIG. 1 embodiment.

FIG. 8 is a front perspective view of the preferred embodiment with additional added details of the optional motor 25 used to contact and release the suspended ball mounted on its extension arm as previously mentioned and shown in the FIG. 1 embodiment. The electrically operated motor revolts at 5 revolutions per minute (RPM) motor and is mounted to the front flat face on the post 15 by an adjustable conventional support (such as a three sided opened bracket with a tightening post engaging screw) bracket 95.

As the ball 7 and its support extension arm are vertically adjusted as described above, the motor can be moved up or down on the post to compensate for changes in the changed ball's height. Extending outwardly from and mounted on the motor's shaft 97 is the long collapsible arm extension 99. The end of the arm 99 is hinged and locks when it is rotated to contact the ball 7.

After initially making contact ,the struck ball is rotated about ⅕ of its full rotation and then the extension 99 is released from engagement with the ball due to its collapsible arm construction. After impacting the ball, the extension arm collapses to insure the user will have sufficient clearance to hit the ball. This optional motor feature is used when the apparatus is set to hit the ball straight down the center of the playing diamond and may, in such a situation, be used by right or left handed batters. The movement imparted to the suspended ball provides an added challenge for a user to strike a moving object similar to a realistic pitching situation.

Figure 9:
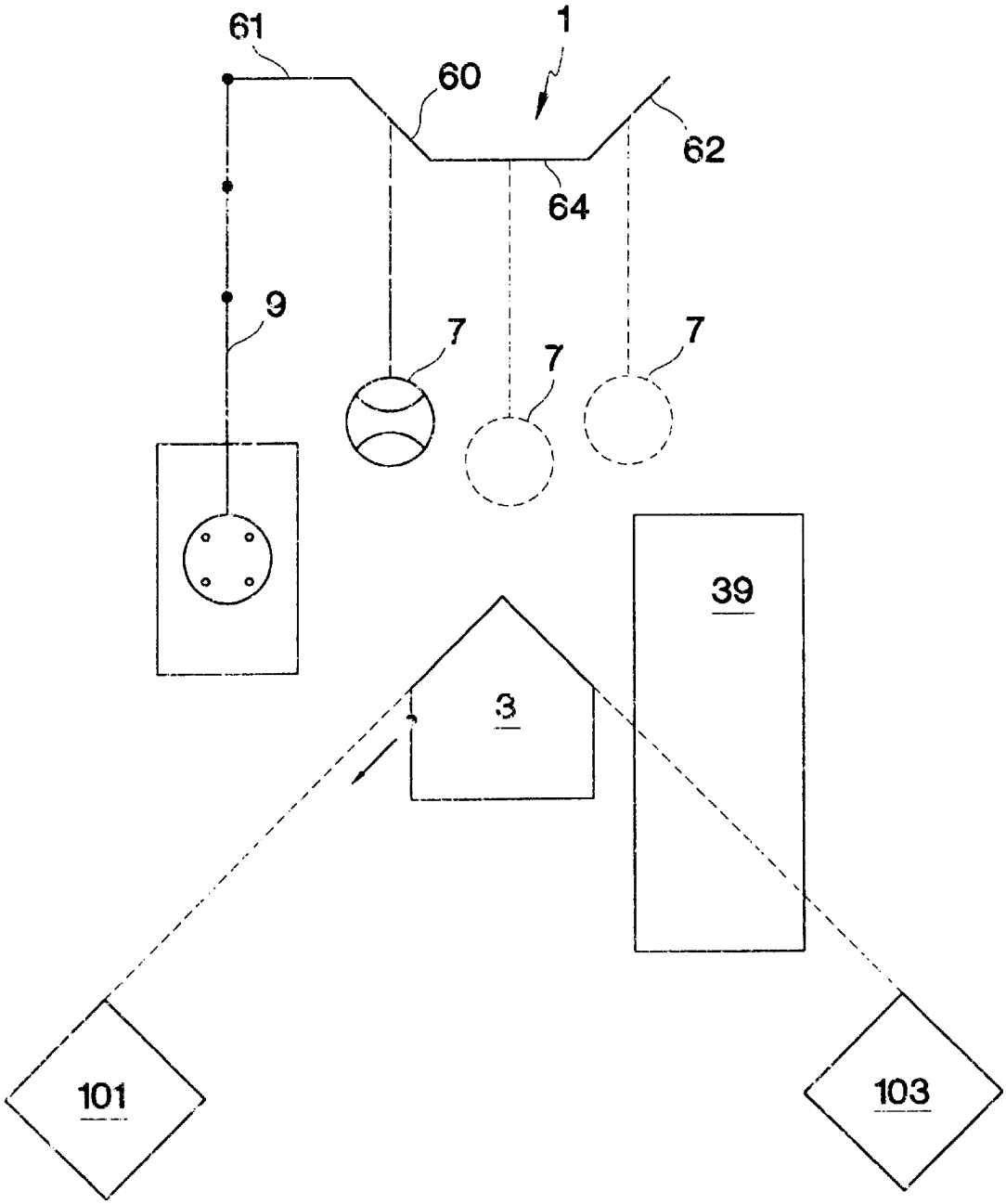
FIG. 9 is a schematic diagram of the FIG. 1 embodiment as used by a right handed batter when the suspended ball may be struck.

FIG. 9 is a schematic diagram of the FIG. 1 embodiment as used by a right handed batter when the suspended ball may be struck to the left by a right handed batter with the suspended ball 7. It shows the simulated flight pattern or trajectory for the ball. As noted, the ball is suspended from arm section 1 while the right handed batter stands in batting box 39 and swings his/her bat to impact the ball to propel it to the left down the baseline towards first base 101 in the direction of the arrow shown near home plate 3. The ball suspending first section 60 has a longitudinal axis which faces in the general direction a squarely struck ball and would probably travel when a pitched ball would just cross the home plate corner, as shown, is struck in the strike zone.

Also shown in dotted line ball 7 format in this figure are the schematic diagram of the FIG. 1 embodiment as used by a right handed batter when the suspended ball may be struck to the right. It shows the simulated flight pattern or trajectory for the ball. This is essentially the same as in full line FIG. 9 except that the ball 7' is suspended from the right or free end section 62 of the arm as illustrated in FIG.3. Thus, when struck in the strike zone the ball's projected flight will travel to the right side of the field towards first base 101 as depicted by the dotted line arrow 7'.

The center dotted line ball 7" is used by a right handed batter when the suspended ball may be struck to the center. The dotted center arrow 7" shows the simulated flight pattern or trajectory for such a struck ball. Again the right handed batter stands in batting box 39 and swings his/her bat such that a solid square hit will propel a ball generally towards the center of the field. Here, the arm's center section 64 longitudinal axis faces in the general direction a squarely struck ball would probably travel when a pitched ball would just cross the home plate edge, as shown, to be in the strike zone.

A heavier version of ball 7 mounted on support arm 1 as shown in the invention's preferred embodiment and FIG. 1 embodiment can be used to provide an increased muscle toning feature when struck. If desired, the,end of the extension arm may be shaped with three sections resembling the angled end sections of the arm 1. The smaller simulated baseballs 7 greatly come in two different configurations. At least one of such suspended baseball 7 simulates a conventional official major league hardball baseball in both appearance, size and weight.

As a player's muscles get more toned, it can be expected that the number of revolutions imparted to the heavier version of ball will equal or maybe even exceed the number of revolutions initially performed by the conventional weighted ball 7. When the larger and heavier ball 33 is struck there is no comparison counter only the development of more muscle tone.

Although the present bat practicing invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A batting practice apparatus comprising:

a five sided lower home plate;

a generally horizontal support base:

an upright support assembly mounted on said base and extending vertically from said support base;

an arm mounted to said vertical upright support assembly and extending in a generally horizontal direction from the support assembly over said home plate, said extension arm consisting of three joined sections, the first of said three joined sections being positioned parallel to a first side of said home plate, the second of said three joined sections being positioned parallel to a second side of said home plate different from said first side of home plate and the third of said joined sections being positioned parallel to a third side of said home plate different from the first and second sides of said home plate that the first and second joined sections are positioned parallel to;

a tethered ball suspended from said extension arm along said joined sections; and plurality of different ball suspension positions located along the three joined sections of said extension arm for suspending said tethered ball over home plate whereby said tethered ball is strikable by a batter in each of the ball suspended positions with said ball suspension positions representing different projected ball flight locations for a thrown ball over home plate depending on its simulated initial ball crossing of home plate within a batter's "strike zone".

2. The apparatus as claimed in claim 1, wherein said vertically disposed upright support assembly has height adjustment mounts for the horizontally disposed extension arm and each of said arm sections having rotatable ball support members.

3. The apparatus as claimed in claim 2, wherein said three joined arm sections with the center section forms approximately the same angular orientation with each of the two joining sections.

4. The apparatus as claimed in claim 3, wherein each of said sections rotatable ball support members have an associated counters for counting the number of their revolutions around the arm when ball suspended from them is hit.

5. The apparatus as claimed in claim 4, wherein said ball's appearance simulates a regulation baseball capable of being suspended from said ball support members.

6. The apparatus as claimed in claim 1, wherein two different balls may be suspended from said arm each having different weights with the same general outer configuration.

7. A batting practice apparatus comprising: a generally horizontal support base:

an upright support assembly mounted on said base and extending vertically from said support base, said upright support having a plurality of arm receiving positions located at different vertical positions above said base;

an arm mountable in any of said extension arm receiving positions of said upright support assembly, said arm having a length with a ball tether mount supported and rotatable on the arm;

a tethered ball simulating a conventional baseball in size and weight depending from said ball tether mount and adapted to rotate relative to the arm with the mount when struck; and a revolution counter operatively associated with said ball tether mount for counting the number of revolutions of said mount when said tethered ball is struck as said tether mount rotates with respect to said supporting arm.

8. The apparatus as claimed in claim 7, also including a second suspended ball having a size and weight larger and heavier than said conventional sized and weighted baseball, said second suspended ball being mounted on a second arm extension extending from and mounted on the upright support assembly.

9. The apparatus as claimed in claim 7, wherein said arm has a plurality of spaced mounts rotatably mounted along on the arm, each of said mounts being adapted to suspend a tethered ball therefrom.

* * * * *